US005850650A

United States Patent [19]

Karsnia

[11] Patent Number: 5,850,650

[45] Date of Patent: Dec. 22, 1998

[54] COMBINATION HAMMER AND LUMBER MANIPULATING TOOL

[76] Inventor: John J. Karsnia, 2729 County Rd. 94, International Falls, Minn. 56649

[21] Appl. No.: 876,165

[22] Filed: Jun. 13, 1997

[51] Int. Cl.[6] ..... B25D 1/04

[52] U.S. Cl. ..... 7/146

[58] Field of Search ..... 7/143, 146, 147

[56] References Cited

U.S. PATENT DOCUMENTS

| | | | |
|---|---|---|---|
| 513,271 | 1/1894 | Matthews | 7/143 |
| 1,469,472 | 10/1923 | Bangert | 7/143 |

*Primary Examiner*—James G. Smith
*Assistant Examiner*—Benjamin M. Halpern
*Attorney, Agent, or Firm*—Michael S. Neustel

[57] ABSTRACT

A combination hammer and lumber manipulating tool for providing a hammer which is capable of being utilized as a lumber manipulating tool for use in combination with an air hammer. The inventive device includes a handle, and a hammer-head having a claw, a socket and a striking head. The hammer-head further includes a jaw attached to a side of the socket distally spaced in opposition to the claw. The distal space between the claw and the jaw is formed to fittingly engage a piece of lumber for manipulating. The jaw preferably includes a plurality of teeth for gripping the piece of lumber.

13 Claims, 2 Drawing Sheets

COMBINATION HAMMER AND LUMBER MANIPULATING TOOL

BACKGROUND OF THE INVENTION

1. Field of the Invention

The present invention relates generally to combination hammer and wrench devices and more specifically it relates to a combination hammer and lumber manipulating tool for providing a hammer which is capable of being utilized as a lumber manipulating tool for use in combination with an air nailer.

2. Description of the Prior Art

There are numerous combination hammer and wrench, and wood turning devices. For example, U.S. Pat. No. 711,408 to Maggard; U.S. Pat. No. 513,271 to Mathews; U.S. Pat. No. 1,308,694 to Boswell; U.S. Pat. No. 4,762,303 to Thomas; U.S. Pat. No. 2,718,374 to Kellenbarger; U.S. Pat. No. 2,585,013 to Johnson; U.S. Pat. No. 4,826,136 to Thomas; U.S. Pat. No. 5,605,319 to Reiley; U.S. Pat. No. 4,620,691 to Waters, Jr.; U.S. Pat. No. 4,621,791 to Staskiewicz et. al.; U.S. Pat. No. 5,382,000 to Rossman; U.S. Pat. No. 5,478,050 to Ott; U.S. Pat. No. 5,575,518 to Payneall are illustrative of such prior art.

Maggard (U.S. Pat. No. 711,408) discloses a hammer-head having a sliding jaw connected to a socket of the hammer-head and a plurality of ratchet-teeth for securing the sliding jaw when adjusted in relation to the claw of the hammer-head.

Mathews (U.S. Pat. No. 513,271) discloses a shank with inclined apertures along its front side in combination with a movable jaw and an inclined dowel pin adapted to engage the apertures.

Boswell (U.S. Pat. No. 1,308,694) discloses a combination wrench, hammer, screw-driver and rule. More specifically, Boswell discloses a hammer-head, a jaw slidably mounted on a shank of the hammer-head, guiding flanges carried by the movable jaw which are engageable upon each side of the shank, and a means for holding the jaw against movement.

Thomas (U.S. Pat. No. 4,762,303) discloses an elongated handle and a head having two opposed and spaced apart claws with one substantially shorter in length than the other. The pair of claws engage opposing sides of a piece of lumber and the elongated handle provides leverage to manipulate the lumber.

While these devices may be suitable for the particular purpose to which they address, they are not as suitable for providing a hammer which is capable of being utilized as a lumber manipulating tool for use in combination with an air nailer. Maggard, Mathews, and Boswell all disclose a hammer with a movable jaw. However, none of the above stated prior art are designed for engaging a piece of lumber for manipulating. They all require added elements for allowing the movable jaw to slide and lock which dramatically increases the weight of the hammer. Further, the connections between the added elements are not perfectly juxtaposed and wear out thereby providing an uneven impact of the hammer when striking an object such as a nail. The invention disclosed by Thomas requires the user to not only carry a conventional hammer and an air nailer, but also requires the user to carry a heavy elongated bar with a pair of claws which is cumbersome and dangerous when working.

Frequently when utilizing an air nailer to force nails into lumber, a piece of lumber will become twisted thereby requiring the user to manipulate the twisted lumber to become straight again. After straightening the previously twisted lumber, the user thereafter air nailers another nail into the previously twisted lumber where it is retained in a straight position. A user usually carries a conventional hammer along with the air nailer in the event the air nailer does not completely force a nail into the piece of lumber. The present invention merely adds an element never utilized before on a conventional hammer without increasing the weight or the character of its strike.

The present invention provides a combination hammer and lumber manipulating tool which does not have any moving parts and is approximately the same weight as a conventional hammer as taught by Maggard, Mathews and Boswell. Since there are no added moving parts, there is no uneven impact of the hammer when striking an object such as a nail. Further, the present invention can be constructed so as to be approximately the same weight as a conventional hammer thereby reducing the amount of weight and number of objects that the user has to carry when workings. Further, the present invention eliminates the need for a second person to retain the position of a piece of lumber with their hands, thereby preventing injuries which can occur from nails being air nailered from an orthogonal piece of lumber.

In these respects, the combination hammer and lumber manipulating tool according to the present invention substantially departs from the conventional concepts and designs of the prior art, and in so doing provides an apparatus primarily developed for the purpose of providing a hammer which is capable of being utilized as a lumber manipulating tool for use in combination with an air nailer.

SUMMARY OF THE INVENTION

A primary object of the present invention is to provide a combination hammer and lumber manipulating tool that will overcome the shortcomings of the prior art devices.

Another object is to provide a combination hammer and lumber manipulating tool that eliminates the need to carry an additional tool to manipulate a piece of lumber.

An additional object is to provide a combination hammer and lumber manipulating tool that is approximately the same weight as a conventional hammer.

A further object is to provide a combination hammer and lumber manipulating tool that does not have any moving parts which can affect the character of the conventional hammer's strike.

Another object is to provide a combination hammer and lumber manipulating tool that reduces injuries to other workers attempting to manipulate a twisted piece of lumber with their hands.

Another object of the present invention is to provide a combination hammer and lumber manipulating tool that fits various widths of lumber.

Another object of the present invention is to provide a combination hammer and lumber manipulating tool that reduces worker fatigue and saves amount of time required to complete a building structure.

Another object of the present invention is to provide a combination hammer and lumber manipulating tool that increases the quality of workmanship done because the tool is always with the worker.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
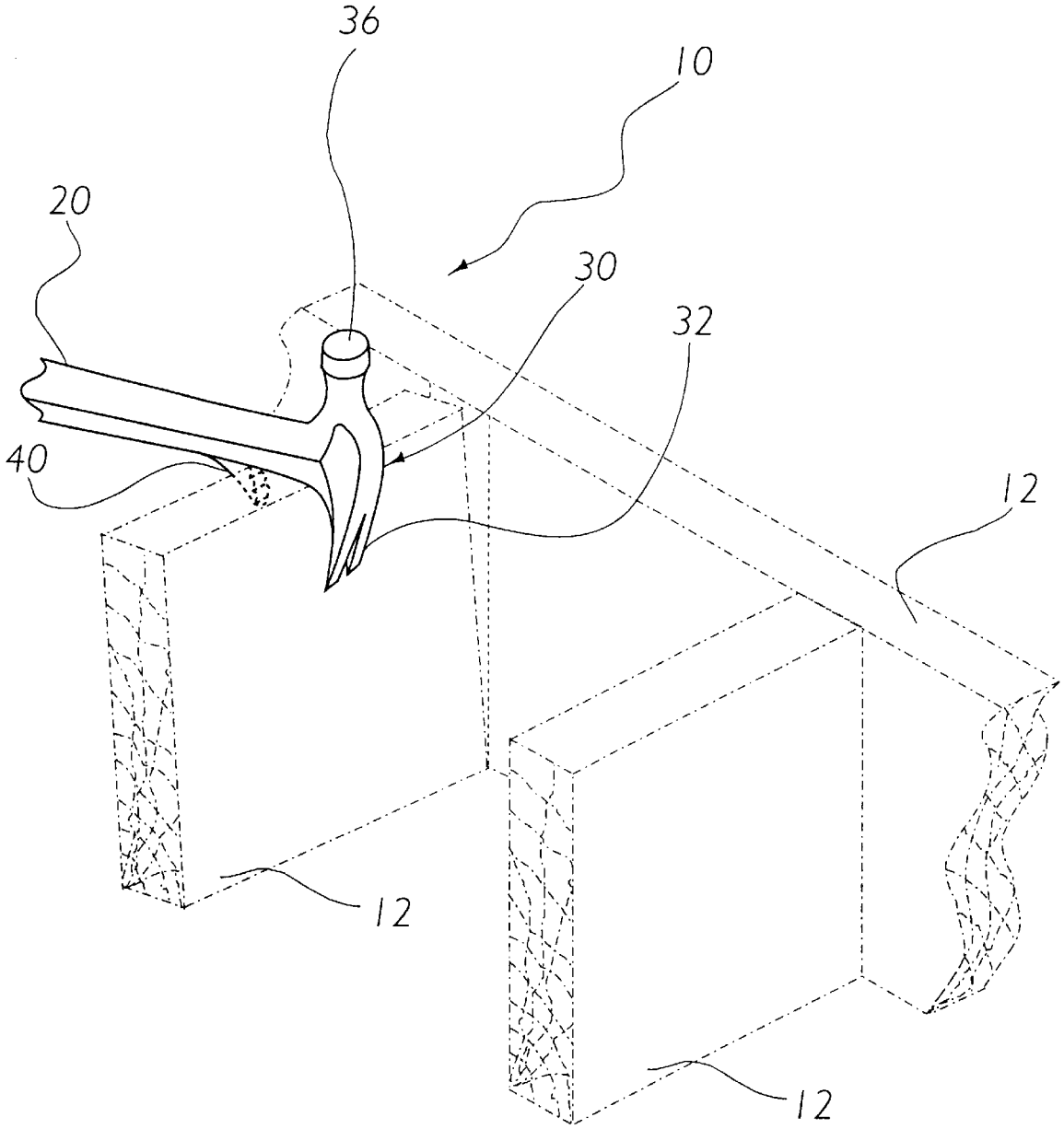
FIG. 1 is an upper perspective view of the present invention removably engaging a piece of lumber.
Figure 3:
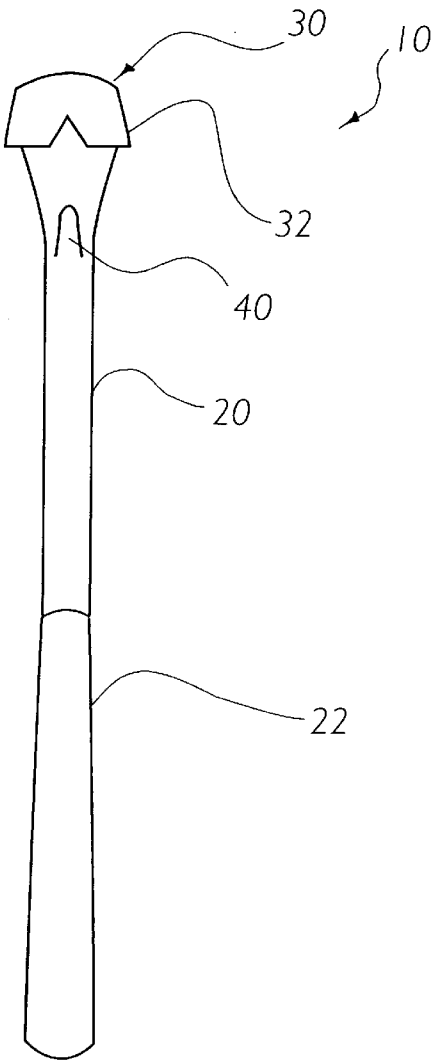
FIG. 3 is a rear view of the present invention.
Figure 2:
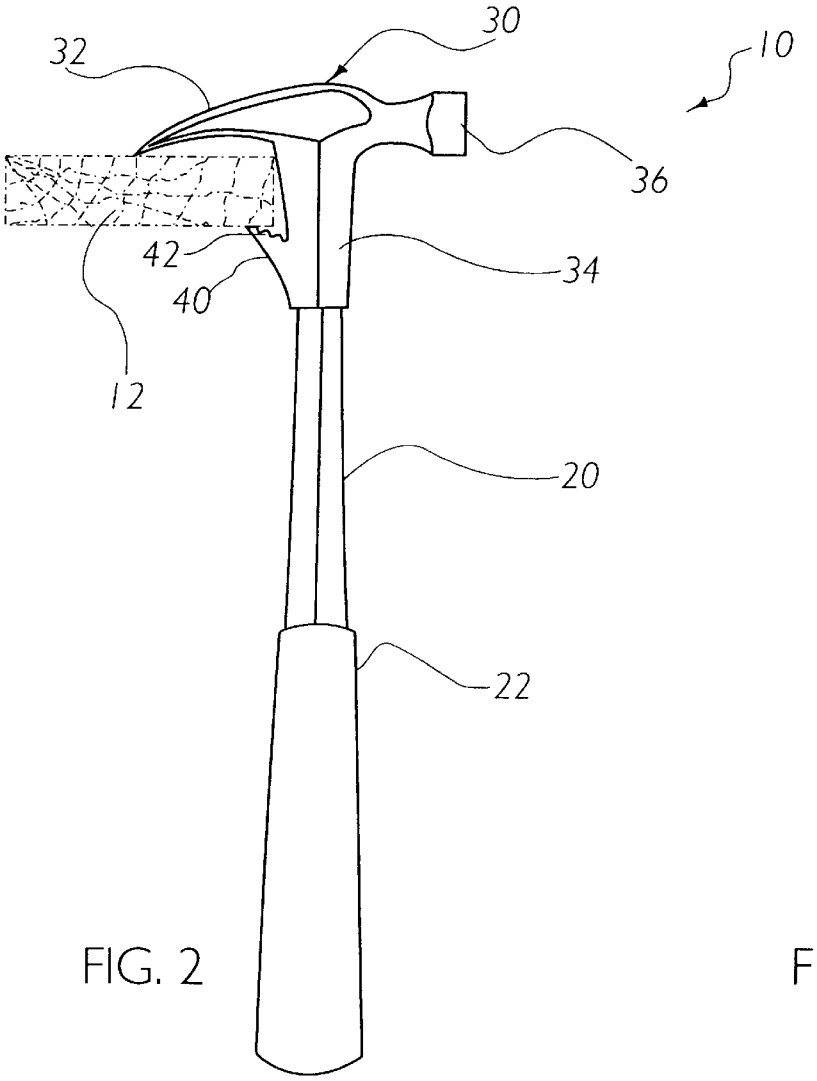
FIG. 2 is a side view of the present invention removably engaging the piece of lumber.

Turning now descriptively to the drawings, in which similar reference characters denote similar elements throughout the several view, FIGS. 1 through 3 illustrate a combination hammer and lumber manipulating tool 10, which comprises a handle 20, and a hammer-head 30 having a claw 32, a socket 34 and a striking head 36. The socket 34 receives the handle 20 as best shown in FIG. 2 of the drawings. A gripping member 22 is preferably attached to a lower portion of the handle 20. The hammer-head 30 further includes a jaw 40 attached to a side of the socket 34 distally spaced in opposition to the claw 32. The distal space between the claw 32 and the jaw 40 is formed to snugly engage a piece of lumber 12 for manipulating. The jaw 40 preferably includes a plurality of teeth 42 for gripping the piece of lumber 12.

As best shown in FIG. 1 of the drawings, the jaw 40 is secured to the socket 34 opposing the claw 32 and spaced from the claw 32 a finite distance. The distance between the claw 32 and the jaw 40 is preferably wider than a width of the piece of lumber 12 as best shown in FIG. 2 of the drawings. The typical width of a conventional piece of lumber 12 is approximately 1½ inches and can vary plus or minus ⅛ of an inch. As shown in FIG. 1, the jaw 40 includes a broad end and a narrow end. The broad end of the jaw 40 is attached to the socket 34 and the jaw 40 preferably tapers upward towards the claw 32 where it forms the narrow end. The distance between the narrow end and the claw 32 is preferably wider than the width of the piece of lumber 12.

As shown in FIG. 2 of the drawings, the jaw 40 has an upper slanted surface opposing the claw 32. The upper slanted surface preferably includes a plurality of teeth 42 for gripping the piece of lumber 12.

In an alternative embodiment, a one piece hammer having only a hammer-head 30 with a claw 32 and a striking head 36 secured to a handle 20 is provided, wherein the jaw 40 is secured to the handle 20 adjacent the claw 32.

In use, when the user air nailers the piece of lumber 12, often the piece of lumber 12 is twisted due to water damage or other reason. Typically the user is forced to twist the lumber 12 by hand or use a tool other than a hammer to manipulate the lumber 12 so that the front edge of the lumber 12 will be flush for securing sheet rock or other sheet material without bulging. The present invention can be utilized as a conventional hammer and as a lumber twisting tool. When the lumber 12 is twisted, the user simply positions the jaw 40 and the claw 32 around a portion of a cross section of the lumber 12. The user manipulates the handle 20 towards the claw 32 thereby forcing the lumber 12 to twist into the desired position, where after the user can air nailer a nail into the lumber 12 to retain it in the proper position. The user simply removes the present invention from the lumber 12 and stores the combination hammer and lumber manipulating tool in their tool belt as they would with a conventional hammer. The jaw 40 further prevents removal of the invention from a loop of the tool belt. The present invention fits various sizes of wood due to treatment or weathered conditions because the jaw 40 is shorter than the claw 32 thereby allowing the lumber 12 to be inserted at an angle into the distal space there between.

As to a further discussion of the manner of usage and operation of the present invention, the same should be apparent from the above description. Accordingly, no further. discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination hammer and lumber manipulating tool for manipulating a piece of lumber, comprising:

a hammer-head having a claw, a striking head and a socket for receiving a handle; and a jaw non-movably secured to said socket opposing said claw and spaced from said claw a finite distance, wherein said piece of lumber is positionable between said jaw and said claw.

2. The combination hammer and lumber manipulating tool of claim 1, wherein said jaw includes a broad end and a narrow end, wherein said broad end is attached to said socket and said jaw tapers upward towards said claw into said narrow end, wherein a longitudinal position of said narrow end is said finite distance from a longitudinal position of a pointed portion of said claw.

3. The combination hammer and lumber manipulating tool of claim 2, wherein said jaw has an upper slanted surface opposing said claw; and wherein said upper slanted surface includes at least one tooth for gripping said piece of lumber.

4. The combination hammer and lumber manipulating tool of claim 3, wherein said finite distance is approximately said width of said piece of lumber for fittingly engaging said piece of lumber.

5. The combination hammer and lumber manipulating tool of claim 4, wherein a total weight of said hammer-head and said jaw is approximately equal to a weight of a conventional hammer-head.

6. A combination hammer and lumber manipulating tool for manipulating a piece of lumber, comprising:

a hammer having a hammer-head and a handle attached to said hammer-head;

said hammer head includes a claw and a striking head; and a jaw non-movably secured to said handle opposing said claw and spaced from said claw a finite distance, wherein said piece of lumber is positionable between said jaw and said claw.

7. The combination hammer and lumber manipulating tool of claim 6, wherein said jaw includes a broad end and a narrow end, wherein said broad end is attached to said handle and said jaw tapers upward towards said claw into said narrow end, wherein a longitudinal position of said narrow end is said finite distance from a longitudinal position of a pointed portion of said claw.

8. The combination hammer and lumber manipulating tool of claim 7, wherein said jaw has an upwardly slanted surface opposing said claw; and wherein said upper surface includes at least one tooth for gripping said piece of lumber.

9. The combination hammer and lumber manipulating tool of claim 6, wherein said finite distance is approximately said width of said piece of lumber for fittingly engaging said piece of lumber.

10. The combination hammer and lumber manipulating tool of claim 9, wherein a total weight of said hammer-head and said jaw is approximately equal to the weight of a conventional hammer-head.

11. The combination hammer and lumber manipulating tool of claim 6, wherein said jaw is angled upwardly towards said claw.

12. The combination hammer and lumber manipulating tool of claim 11, wherein said jaw includes at least one tooth.

13. The combination hammer and lumber manipulating tool of claim 12, wherein said jaw includes one tooth attached at a distal end of said jaw for engaging said piece of lumber.

* * * * *